United States Patent [19]

Heideman et al.

[11] Patent Number: 4,702,187

[45] Date of Patent: Oct. 27, 1987

[54] BOTTOM CONSTRUCTION FOR A SHIP

[75] Inventors: Torsten Heideman; Kai Levander, both of Kauniainen; Pekka Salmi, Vantaa, all of Finland

[73] Assignee: Oy Wartsila Ab, Helsinki, Finland

[21] Appl. No.: 841,330

[22] Filed: Mar. 19, 1986

[30] Foreign Application Priority Data

Apr. 1, 1985 [FI] Finland ..... 851312

[51] Int. Cl.[4] ..... B63B 35/08

[52] U.S. Cl. ..... 114/40

[58] Field of Search ..... 114/40–42, 114/357, 56, 57

[56] References Cited

U.S. PATENT DOCUMENTS

| | | | |
|---|---|---|---|
| 3,174,166 | 3/1965 | Ehrenberg et al. | 114/357 |
| 4,029,035 | 6/1977 | German | 114/40 |
| 4,326,476 | 4/1982 | Pole | 114/40 |
| 4,436,046 | 3/1984 | Braley | 114/40 |

FOREIGN PATENT DOCUMENTS

| | | | |
|---|---|---|---|
| 2212145 | 9/1973 | Fed. Rep. of Germany | 114/40 |
| 2431650 | 1/1976 | Fed. Rep. of Germany | 114/41 |
| 901153 | 2/1982 | U.S.S.R. | 114/40 |

*Primary Examiner*—Joseph F. Peters, Jr.
*Assistant Examiner*—Stephen P. Avila
*Attorney, Agent, or Firm*—Dellett, Smith-Hill & Bedell

[57] ABSTRACT

The invention relates to a ship that is adapted for operating in ice-filled waters and has a general frame form defining a substantially horizontal bottom surface, two side surfaces, a stern and a blow portion that breaks the ice advantageously. The bottom surface comprises one or a greater number of cavities, extending to or located on both sides of the longitudinal symmetry plane of the ship, in which cavity or cavities there are arranged movable sheetlike elements. The sheetlike elements have a first position, in which said elements form a generally continuous part of the bottom surface, and a second position, in which said elements form, below the bottom surface, a substantially vertical wedge-shaped structure that converges in the direction from the stern of the hull towards the bow of the hull. The elements are provided with power units which bring about movement of the elements from one position to another by turning around a swivelling axis arranged in the longitudinal direction of the elements.

23 Claims, 8 Drawing Figures

11
9
10
P
S
7
5
3
13
4
13
13
6
3
R
b
k
8

Z
9
6
6
3
k
3
5
4
4
5

BOTTOM CONSTRUCTION FOR A SHIP

This invention relates to a bottom construction for a ship adapted for operation in ice-filled waters.

A considerable part of the adverse effects on the forward movement of an ice-breaking ship operating in icy waters is caused by the frictional work between the broken chunks of ice and the outer surfaces of the ship's hull. By directing at least a big part of the chunks of ice away from the drive channel, under the edges of the solid ice, this friction will decrease. At the same time there is also achieved the advantage, that the propellers of the ship are protected from the broken ice, and the forward movement of ships following the ice-breaker in the drive channel is made easier.

In order to direct the broken ice away from beneath the ship, there has been suggested different frames of a ship's hull. In the Finnish Patent Application No. 840995, there is described a ship comprising an inclined bottom surface between the side surfaces and the horizontal bottom part of the ship. This construction is able to decrease the amount of ice that gets underneath the ship. Another arrangement for directing the chunks of ice in the lateral direction is presented in the Finnish Patent Application No. 850862. A wedge-shaped plow, extending from the bottom of the stem line and diverging in the direction backwards, removes the chunks of ice far beyond the reach of the propellers of the ship, and to a great extend below the edges of the solid ice field. The drawback of such a hull construction is, however, a poorer seaworthiness and bigger driving resistance compared with a conventional ship's hull. A stationary plow construction also permanently increases the draught of the ship and decreases its displacement.

The object of the invention is to create a new arrangement, which is more efficient than before in directing broken chunks of ice in the lateral direction, away from beneath the bottom of an ice-breaking ship. The object is also to create such an arrangement, which is adjustable in order to guarantee good seaworthiness and manouverability and a small drive resistance in open water conditions. The object is furthermore to create an arrangement, in which the increase in the draught of the ship can be reduced when moving in shallow places. In addition to this, the object of the invention is to create an arrangement that is able to prevent the ship from driving upon a carrying layer of solid ice till it gets jammed.

According to the invention, there are placed movable sheetlike elements in cavities in the bottom of the ship, which elements in their first position are forming a continuous part of the substantially horizontal bottom surface of the ship. By means of power units, the elements are turnable around a swivelling axis into a second position, so that there is formed, below the bottom of the ship, a substantially vertical, wedge-shaped ice plow, which converges in the direction from the stern of the hull towards the bow. This plow is able, correspondingly to the bottom construction presented in the Finnish Patent Application No. 850862, to direct the broken chunks of ice efficiently in the lateral directions away from the drive channel and from under the ship. When moving in open waters, the sheetlike elements are in a turned-in position, whereat the drive resistance of the ship is lower and its seaworthiness and manouverability considerably better than in a ship comprising a stationary plow construction. A turnable plow also brings that advantage, that, for example, when a river ice-breaker is moving over a shallow place, the draught of the ship is easily reduced for a short time by turning the plow elements inwards.

The efficiency of the ice plow is heavily dependent on the water currents it causes in the surroundings. A vertical plow with list-like edges that end in a point causes strong water currents below its edges, which currents are likely to bring chunks of ice to the backside of the plow. The occurrence of such currents is reduced by forming a small opening at the front end of the flow, or alternatively by forming the inner surfaces of the plow sloping.

According to a preferred embodiment of the invention, the plow is formed by two substantially rectangular sheet elements having longitudinal swivelling axes in the region of the edge located farther outwards from the longitudinal symmetry plane of the ship. The sheet elements are provided with stiffeners and they form an angle of 30° . . . 90° between each other. In ice conditions, the sheetlike elements are turned by means of power units about 90° around the swivelling axis, so that the bottoms of the sheetlike elements form the side surfaces of the ice plow in a list-like manner. The chunks of ice, which have been broken by the bow of the ship and subsequently are depressed below the ship, are during the forward movement of the ship sliding along these side surfaces of the plow in a direction rearwards and outwards.

The sheet elements are according to one embodiment of the invention formed as rectangles with a corner of the rectangular sheet cut off, and the elements are placed symmetrically on each side of the symmetry plane of the ship. According to another embodiment of the invention, two rectangular sheets are placed in the bottom at different longitudinal levels of the ship. In both cases, when the sheet elements are turned to form a plow, there is formed a narrow opening between the side surfaces of the plow at the front edge of the plow. This opening permits a non-turbulent flow of water to the inside of the plow. Due to this flowing, it is able to avoid, to the greatest extent, flowing of water and sliding of chunks of ice below the edge of the plow to the bottom of the ship.

According to another embodiment of the invention, both of the sheet-like plow elements are provided with a longitudinal wall construction at their outermost edge, which wall construction extends in a direction inwards from the bottom of the plow element. When the sheet elements are turned about 20°–50° around a swivelling axis located in the region of the opposite edge of the element, said walls are forming the side surfaces of the plow. In this embodiment, the front edge of the plow is sharply formed. However, the flowing below the edge of the plow will still not cause any noticeable drawback due to turbulence, because the inside of the plow has an advantageous inclined surface.

It is advantageous to construct the sheetlike elements of two or a greater number of sheet segments placed one after another, so that every sheet segment has its own power units. This is an advantageous solution constructionally and also in consideration of maintenance, and furthermore one can by this means avoid the strains that the internal movement of the ship's hull direct against the plow elements.

In a preferred embodiment, the inside of the plow elements is made closed, preferably so that the space created is filled with foamy polymers or some corresponding material that is impervious to water. By this means the reducing effect of the turnable plow element upon the displacement can mainly be eliminated.

The substantially vertical side surfaces of the plow form, between each other in the area between the side surfaces, an angle of 30° . . . 90°. The side surfaces should preferably extend all over the breath of the bottom part of the ship. The vertical height of the side surface of the plow is preferably 50–120% of the limit value of thickness of the ice-breaking quality of the ship. This concept means the thickness level ice a ship is able to break during continuous advancement, and this feature is mostly the basis for planning a new ice-breaking ship.

The bottom construction of a ship according to the invention is preferably adaptable to the bow portion of such a hull, which is presented in the Finnish Patent Application No. 850862. The distance from the front edge of the plow to the lowermost point of the stem line has to be at least 3 times the limit value of thickness of the ice-breaking quality of the ship. When a stem line consisting of two parts is used, accoring to the Finnish Patent Application No. 850862, the distance is measured from the junction, from which the angle of the stem line to the water line plane is at the most 15°, preferably at the most 10°. This arrangement will lower enough the velocity downwards of the chunks of ice before the chunks meet the plow, due to which feature they won't slide below the edge of the plow to the bottom of the ship. By choosing a suitable distance from the bow to the plow, a plow construction according to the invention furthermore has the advantage, that one by this means is able to prevent the ship from driving upon a carrying layer of solid ice till it gets jammed. Hereby the side surface have to be built strong enough to bear the strains due to this, which strains locally may exceed 5 MPa.

In connection with a bottom construction according to the invention, there may also be used discharge openings for pressurized air, as known for example from the Finnish Patent No. 47061, in order to diminish the drive resistance and to make the disengagement from ice easier.

The invention will now be described, by way of example, with reference to the accompanying drawing, in which FIG. 1 is a schematical side view of the bow portion of a ship's hull according to the invention;

Figure 1:
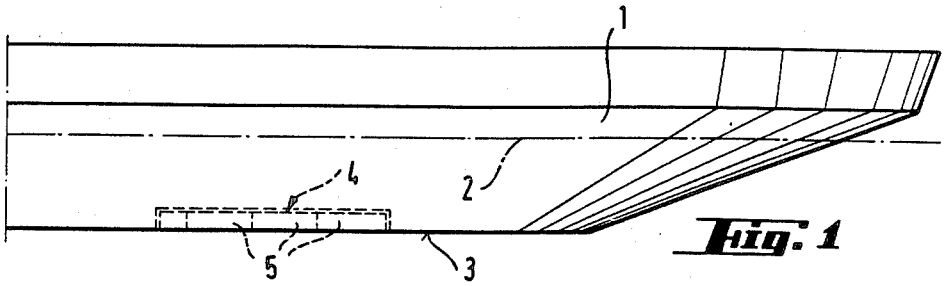

In the drawing, reference 1 relates to the vertical or in the direction upwards-outwards inclined side surfaces of the ship. The side surfaces 1 are joined, preferably with roundings, to the substantially horizontal bottom surface 3 of the ship. The bottom surface 3 may also consist of two symmetrical sections, so that the left and the right halves of the bottom surface 3 form between each other a small angle along the longitudinal symmetry plane Z. Reference 2 relates to the constructional water line of the ship.

In FIGS. 2–6, there has been formed cavities in the bottom surface 3, in which cavities there has been depressed sheetlike elements 4, which are substantially rectangular. The sheet elements 4 are divided into segments 5, each of which is provided with a power unit 11, which preferably is a hydraulic cylinder. In connection with the segments 5 of the sheet elements 4 there are arranged hinge units 10, by means of which the segments 5 are turnable in the direction R through approximately 90° around their swivelling axis 6, so that the side surfaces of the sheetlike plow elements in their downwards turned position 8 (FIG. 5) form a substantially 90° angle b to the bottom surface 3. Reference 9 relates to the double bottom or tank top. The turning of the plow element is accomplished by means of the power unit 11, the power transmission means of which is pushable in the direction S and movable in the direction P. The power transmission means is, at its lower end, articulated to the segment 5 by joint 7. The segment 5 is provided with stiffeners 13 in its longitudinal and/or transverse direction. The distance l from the front edge of the plow to the ending point of the stem line, is at least three times the limit value of thickness of the ice-breaking quality of the ship. The height k of the plow is, in a position where it is turned down, 50–120% of the limit value of thickness. The height of the plow may of course vary somewhat along its edges, preferably so that the height increases toward the stern of the ship. The side surfaces of the plow 4 form together, in the area between the side surfaces, an angle a that is preferably 30°–90°. In the drawing, reference 15 relates to the air discharge openings of an air bubbling system.

Figure 2:
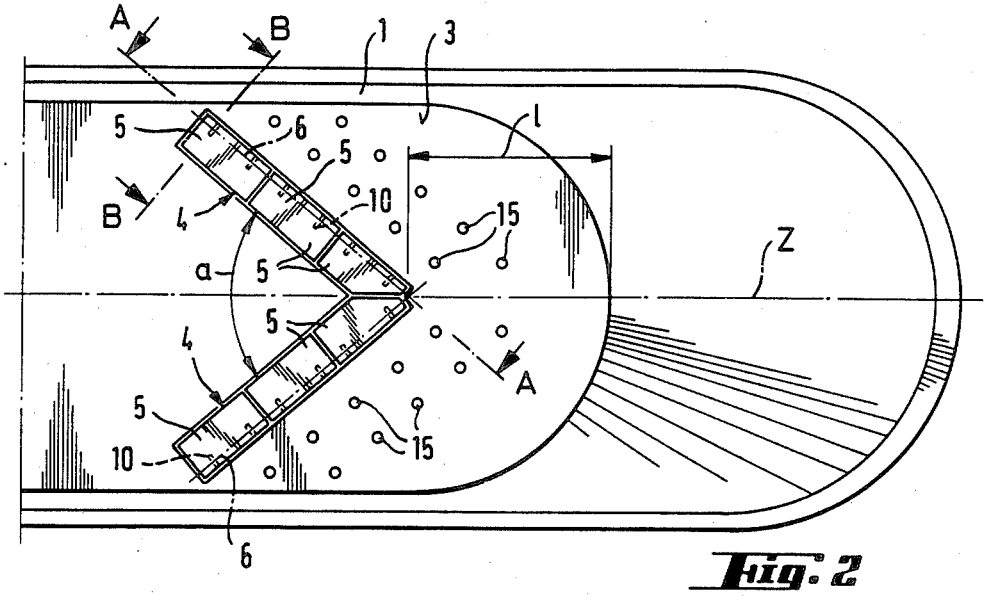
FIG. 2 is a bottom plan view of an embodiment of the invention, the plow being in a upwards turned position.
Figure 3:
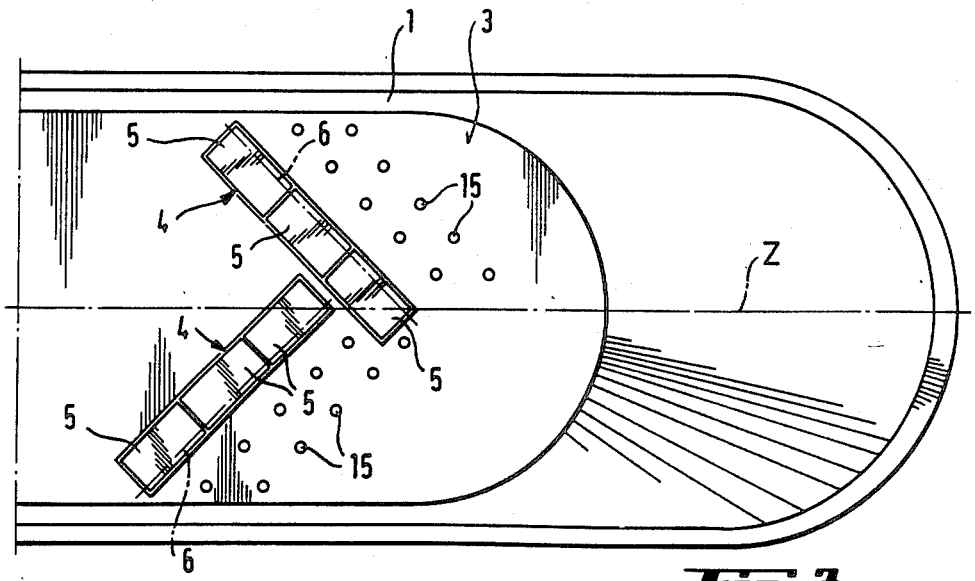
FIG. 3 is a bottom plan view of another embodiment of the invention, the plow being in a upwards turned position.
Figure 4:
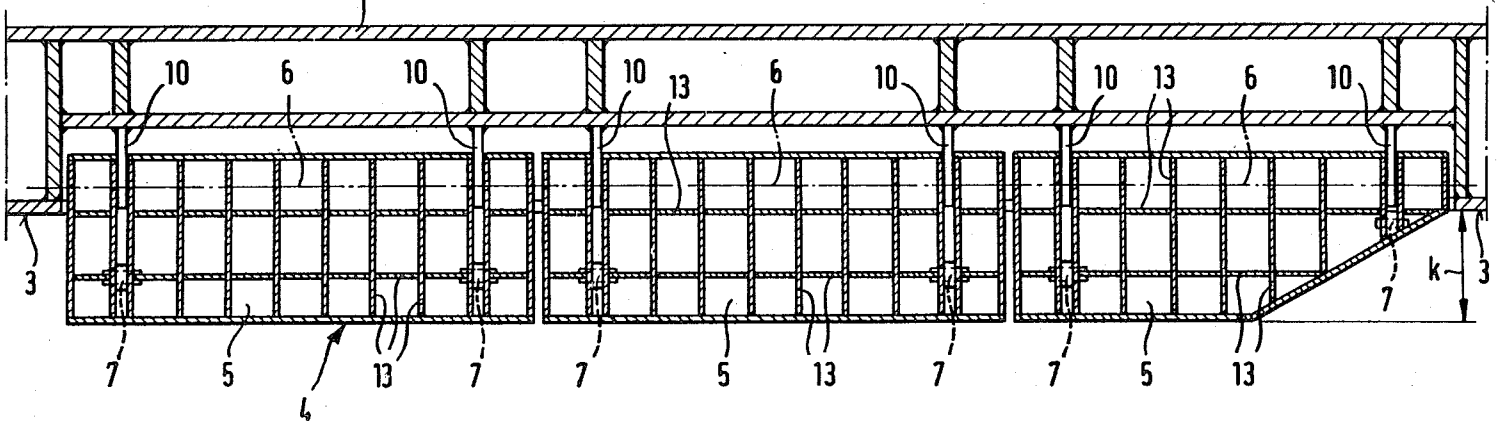
FIG. 4 is a sectional view of the plane A—A of the bottom construction according to FIG. 2, the plow being in a downwards turned position.
Figure 5:
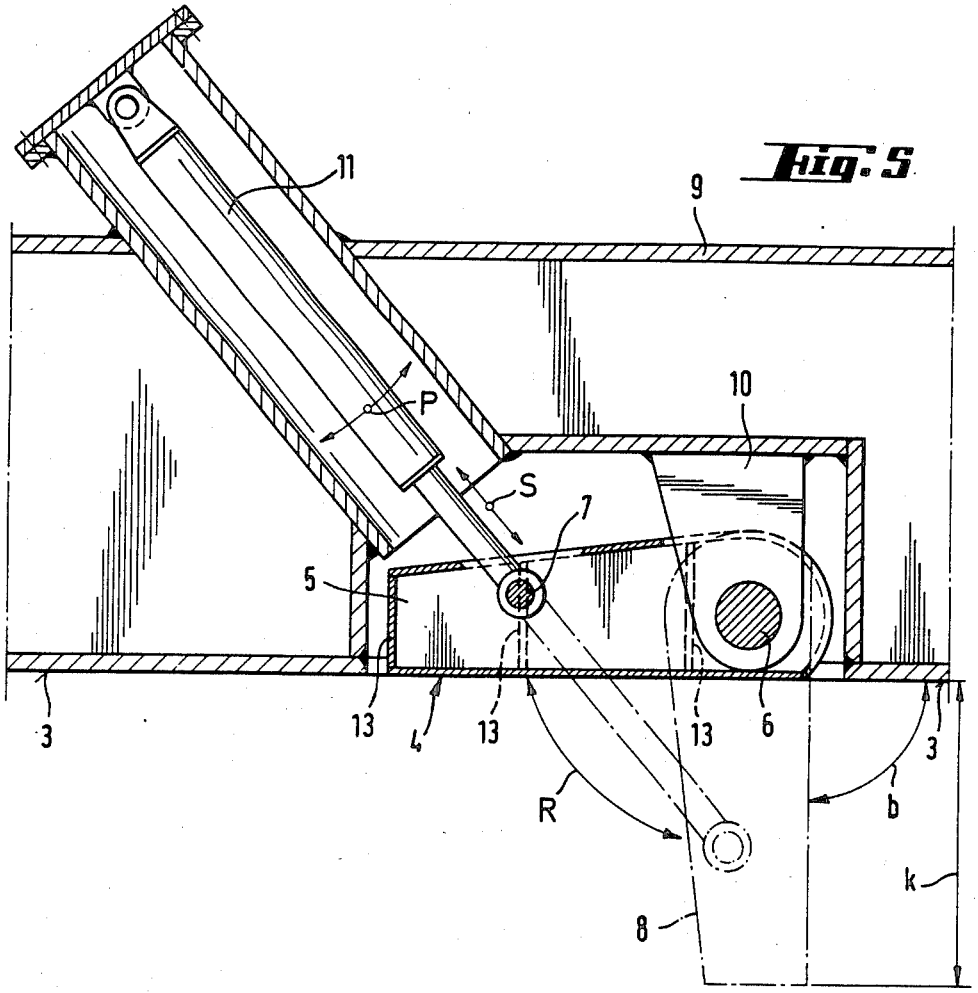
FIG. 5 is a sectional view in the plane B—B of a bottom construction according to FIG. 2.
Figure 6:
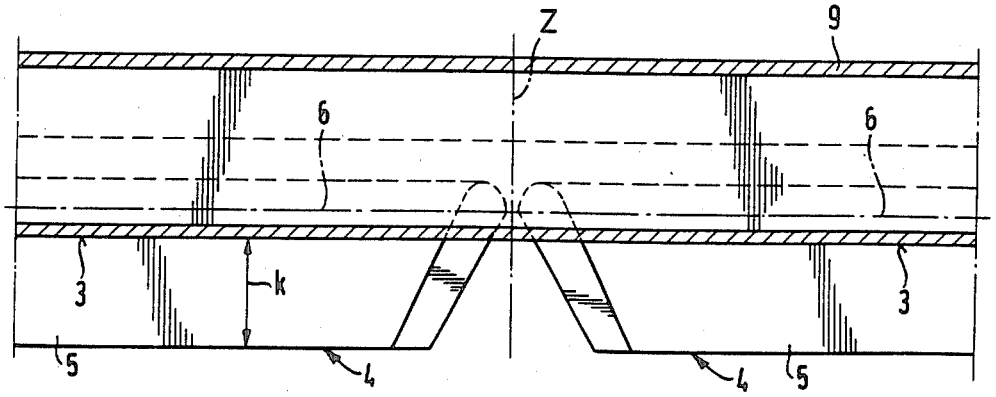
FIG. 6 shows a bottom construction according to FIG. 2, viewed from the bow of the ship, the plow being in a downwards turned position.

In FIG. 2, the sheetlike plow elements 4 are placed symmetrically on both sides of the bottom part. The elements 4 are formed substantially rectangular, with the corner adjacent the symmetry plane cut off, in order to be able to place the elements closer to each other. When the elements are turned, an opening is formed at the front of the plow (FIG. 6). This opening allows water to flow to the backside of the plow, which evens the water pressures on both sides of the elements 4 so that the turbulence is lessened. In the embodiment of FIG. 3, the plow elements 4 are placed at different longitudinal position on the bottom surface 3. Hereby the elements may be formed wholly rectangular, so that they extend somewhat over the longitudinal symmetry plane of the bottom surface. When the elements 4 are turned to form a plow, an opening is formed between the elements along the symmetry plane Z. This opening serves the same purpose as the opening of the embodiment of FIG. 2.

Figure 7:
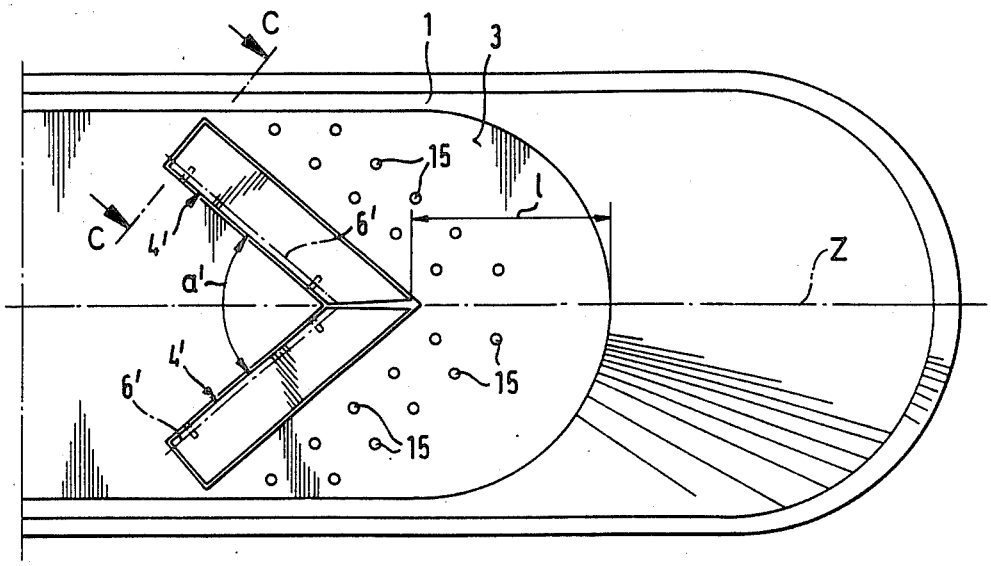
FIG. 7 shows a further embodiment of a bottom construction according to the invention, viewed from below.
Figure 8:
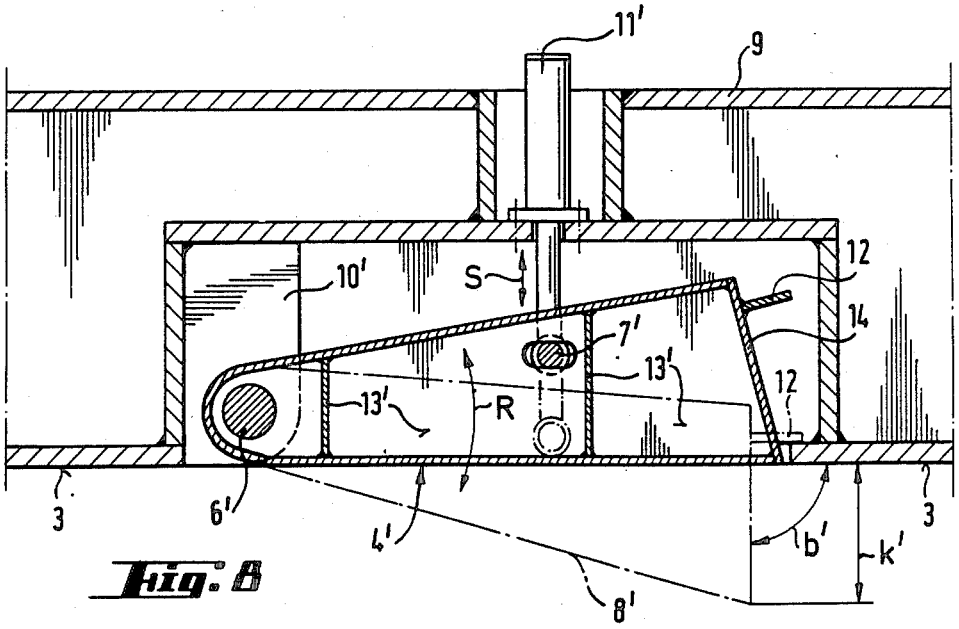
FIG. 8 presents a sectional view in the plane C—C of a construction according to FIG. 7.

In FIGS. 7 and 8, there is presented another embodiment of the invention. The hinging of plow elements 4' is accomplished in the region of that longitudinal edge of the sheets, which is located closer to the symmetric plane. The plow element 4' is at its opposite edge provided with a wall construction 14, which forms the side surface of the plow when the plow element 4' is turned down along its swivelling axle 6' in the direction R. By means of the support element 12, the plow element 4' is positioned into its correct position 8', when the plow is in a downwards turned position. The hinge unit 10', the joint 7', the stiffeners 13', the power unit 11', the height k' and the angles a' and b', correspnd to the corresponding conceptions of the first embodiment. In this embodiment the plow ends in a point. The backside surface of the plow is, however, sloping so there won't occur any disturbing turbulence.

In a preferred embodiment, the entity of the bottom, the wall constructions and the stiffeners of segment 5 is made closed so, that the space thus generated is filled with a suitable foamed polymeric material (not shown), the water absorbtion ability of which is low. By this means the lowering effect of the sheet elements upon the displacement of the ship can be diminished.

The invention is not limited to the embodiments shown, but several modifications of the invention are feasible within the scope of the enclosed claims.

We claim:

1. A ship that is adapted for operating in ice-filled waters and has a general frame form defining a bottom surface, two side surfaces, a stern and a bow portion that breaks the ice advantageously, said bottom surface being substantially horizontal both longitudinally and transversely of the ship and comprising one or a greater number of cavities, extending to or located on both sides of the longitudinal symmetry plane of the ship, in which cavity or cavities there are arranged movable sheet-like elements having a first position, in which said elements form a generally continuous part of the bottom surface, and a second position, in which said elements form, below the bottom surface, a substantially vertical wedge-shaped structure that converges in the direction from the stern of the hull towards the bow of the hull, said elements being provided with power units which affect said elements to bring about their movement from one position to another, said movement taking place by means of turning around a swivelling axis arranged in the longitudinal direction of said elements.

2. A ship according to claim 1, wherein said sheetlike elements are substantially rectangularly shaped with their swivelling axis arranged in the region of the outermost edge with regard to the symmetry plane of the ship, said movement from one position to another taking place by means of turning about 9° around said axis.

3. A ship according to claim 2, wherein the sheetlike elements are arranged substantially symmetrically on both sides of the longitudinal symmetry plane of the ship.

4. A ship according to claim 3, wherein the sheet-like elements adjacent the longitudinal symmetry plane of the ship are formed as rectangles with the corner facing the symmetry plane cut off so that when the sheet-like elements are in the second position, an opening is provided between the sheet-like elements are the forward end of the wedge-shaped structure.

5. A ship according to claim 2, wherein the sheet-like elements on each side of the longitudinal symmetry plane of the ship are located at different levels of the longitudinal extension of the ship so that when the sheet-like elements are in the second position, an opening is provided between the sheet-like elements at the forward end of the wedge-shaped structure.

6. A ship according to claim 1, wherein said sheetlike elements are each provided with a wall construction extending upwards from the bottom plane of the ship at the longitudinal edge located outermost to the symmetry plane of the ship, the swivelling axis being located in the region of the opposite edge so, that said wall construction form the side surfaces of the wedge-shaped structure when turning the element around said swivelling axis.

7. A ship according to claim 6, wherein the movement of the sheetlike element from one position to another is accomplished by means of turning 20° . . . 50° around the swivelling axis.

8. A ship according to claim 1, wherein the sheetlike elements are provided with stiffeners.

9. A ship according to claim 8, wherein the space generated by the bottom sheet of the sheetlike element and the stiffeners is made closed.

10. A ship according to claim 9, wherein said closed space is filled with a material of which the water absorption ability is small.

11. A ship according to claim 1, wherein the power unit is a hydraulic cylinder.

12. A ship according to claim 1, wherein the side surfaces of the wedge-shaped construction form an angle of 30° . . . 90° in the area between the side surfaces.

13. A ship according to claim 1, wherein said wedge-shaped structure extends at least substantially all over the breath of said bottom surface.

14. A ship according to claim 1, wherein the vertical height of the wedge-shaped structure is 50 . . . 120% of the limit value of thickness of the ice-breaking quality of the ship.

15. A ship according to claim 1, wherein the distance from the front edge of the wedge-shaped structure to the lowermost point of the stem line of the ship is at least three times the limit value of thickness of the ice-breaking quality of the ship.

16. A ship according to claim 15, wherein said distance is chosen so, that the wedge-shaped structure is able to prevent the ship from driving upon a carrying layer of solid ice till is gets jammed.

17. A ship according to claim 1, wherein arranged discharge openings for pressurized air are arranged in the lower part of the ship.

18. A ship according to claim 10, wherein said material is a foamed polymer material.

19. A ship according to claim 17, wherein the discharge openings are in the region of the side surfaces of the wedge-shaped structure.

20. A ship that is adapted for operating in ice-filled waters and comprise:

a hull having a general frame form defining a bottom surface, two side surfaces and a bow, the bottom surface of the hull being substantially horizontal both longitudinally and transversely of the hull, the general frame form of the hull being substantially symmetrical about a longitudinal plane of the ship, and there being at least one cavity formed in said bottom surface, first and second elongate sheet-like members extending to opposite sides respectively of the longitudinal symmetry plane of the ship, pivotal mounting means attaching the elongate sheet-like members to the hull of the ship in a manner that permits pivotal movement of each sheet-like member about an axis that is longitudinal of the sheet-like member, and power means connected to the sheet-like members to bring about pivotal movement of each sheet-like member between a first position, in which the sheet-like member is substantially completely inside a cavity in the bottom surface of the hull and forms a generally continuous part of the bottom surface, and a second position, in which the sheet-like member projects downwardly from the bottom of the hull, the sheet-like members being so disposed that when the two sheet-like members are in the second position they form a substantially wedge-shaped structure defined by two substantially vertical sides that converge in the direction towards the bow of the hull.

21. A ship according to claim 20, wherein each of the elongate sheet-like members has a minor portion disposed on one side of the longitudinal symmetry plane of the ship and a major portion disposed on the other side of the longitudinal symmetry plane of the ship.

22. A ship according to claim 20, wherein each sheet-like member has a first surface that is substantially flush with the bottom surface of the hull when the sheet-like member is in the first position and has a second surface that, when the sheet-like member is in the first position, extends upwards from the first surface at the longitudinal edge of the sheet-like member that is farther from the longitudinal symmetry plane of the ship, the axis of pivotal movement being located in the region of the opposite longitudinal edge of the sheetlike member so that the second surface forms a side surface of the wedge-shaped structure when the sheetlike member is in the second position.

23. A ship according to claim 22, wherein the movement of the sheet-like member from one position to the other is accomplished by means of turning around the axis of pivotal movement through an angle in the range from 20 degrees to 50 degrees, whereby in the second position the first surface of the sheet-like member is inclined to the bottom surface of the hull substantially at an angle in the range from 20 degrees to 50 degress.

* * * * *